US006037010A

United States Patent [19]

Kahmann et al.

[11] Patent Number: 6,037,010

[45] Date of Patent: Mar. 14, 2000

[54] PAINT SPRAYING EQUIPMENT AND METHOD OF CLEANING THE SAME

[75] Inventors: Ralf Kahmann, Heusenstamm; Udo Klein, Dietzenbach; Winfried Ott, Rodgau; Volker Weiss, Frankfurt, all of Germany

[73] Assignee: LacTec Gesellschaft fuer moderne Lackiertechnik mbH, Rodgau, Germany

[21] Appl. No.: 09/105,505

[22] Filed: Jun. 26, 1998

[30] Foreign Application Priority Data

Jul. 3, 1997 [DE] Germany ..... 197 28 155

[51] Int. Cl.[7] ..... B05B 15/02; B05D 1/02

[52] U.S. Cl. ..... 427/421; 118/302; 222/148; 239/113; 239/116

[58] Field of Search ..... 118/302; 427/421; 222/148, 334; 239/112, 113, 116

[56] References Cited

U.S. PATENT DOCUMENTS

| | | | |
|---|---|---|---|
| 2,965,114 | 12/1960 | Harden | 137/1 |
| 5,192,595 | 3/1993 | Akeel et al. | 427/421 |
| 5,221,047 | 6/1993 | Akeel | 239/123 |
| 5,289,947 | 3/1994 | Akeel et al. | 222/108 |
| 5,326,031 | 7/1994 | Konieczynski | 239/3 |
| 5,582,350 | 12/1996 | Kosmyna et al. | 239/345 |

FOREIGN PATENT DOCUMENTS

| | | |
|---|---|---|
| 3927880 | 1/1991 | Germany . |
| 4133840 | 4/1993 | Germany . |
| 4342128 | 6/1995 | Germany . |

*Primary Examiner*—Shrive Beck
*Assistant Examiner*—Jennifer Calcagni
*Attorney, Agent, or Firm*—W. F. Fasse; W. G. Fasse

[57] ABSTRACT

In a method of cleaning a paint application system when switching between two different types or colors of paint, at least a predominant portion of the first paint (35) remaining in a paint line (3) is caused to flow back into its paint supply container (5). Then the entire paint line is flushed out using a flushing medium, before supplying the second paint through the paint line. In this manner, the paint remaining in the painting system at the end of a painting cycle is not wasted, but rather is saved to later be reused. A paint application apparatus includes a paint supply switching device (4), at least two paint supply containers (5 to 8), a paint spray nozzle (2), and a paint line (3) connecting the color switching device (4) to the spray nozzle (2). Two receiver stations (28) and (31) are interposed in the paint line (3), and a shuttle element in the form of a pipe cleaner swab (29) is arranged in the paint line (3) so as to be able to shuttle back and forth between the two receiver stations. A pressure medium or flushing medium can be introduced into the paint line (3) between the first receiver station (28) and the spraying nozzle (2), so as to push the pipe cleaner swab (29) through the paint line (3) to the second receiver station (31). Thereby, the paint remaining in the paint line (3) is pushed back into the paint supply container.

26 Claims, 6 Drawing Sheets

PAINT SPRAYING EQUIPMENT AND METHOD OF CLEANING THE SAME

CROSS-REFERENCE TO RELATED APPLICATION

This application is related to our copending U.S. application Ser. No. 09/244,928 filed on Feb. 4, 1999.

PRIORITY CLAIM

This application is based on and claims the priority under 35 U.S.C. §119 of German Patent Application 197 28 155.9, filed on Jul. 3, 1997. The entire disclosure of German Patent Application 197 28 155.9 is incorporated herein by reference.

FIELD OF THE INVENTION

The invention relates to a method and an apparatus for applying paint or other coatings by spraying or the like, and particularly relates to an arrangement and method for cleaning and readying a paint conveying conduit when switching from a first paint that has been sprayed, to a second paint, for example having a different color.

BACKGROUND INFORMATION

Especially in the field of industrial mass production painting, it is typical to use an automatic color switching device, when a given series of the same or similar workpieces are to be painted with different colors. Such color switching devices for use in connection with painting equipment and particularly spraying equipment are generally known, and are shown and described in German Patent Laying Open Document 4,342,128 (Sonnleitner et al.), for example.

Since it is absolutely necessary that a respective type-pure paint of the proper type is provided at the paint application point at any given time, the conduit or line conveying the respective paint and all components of the equipment that come in contact with the paint must be adequately cleaned in order to ensure an absolute paint-type purity when switching over from one paint to another. The effort involved in draining, flushing and otherwise readying the equipment in this context is substantial. The situation is made worse because considerable quantities of paint which are present in the paint supply line and/or the associated components of the equipment, are lost or wasted whenever the equipment is switched over from one paint to another.

SUMMARY OF THE INVENTION

In view of the above it is an object of the invention to provide a method and an apparatus by means of which it is possible to minimize the effort and the loss of paint while cleaning and readying the paint conveying lines and associated components, when switching over from one paint to another. The invention further aims to avoid or overcome the other disadvantages of the prior art, and to achieve additional advantages, as apparent from the present description.

The above objects have been achieved in a method according to the invention, whereby at least a substantial portion of the paint located in the paint supply lines at the time a switch-over is to be carried out, is caused to flow back into its paint supply container when carrying out the cleaning step. In contrast to the prior art methods, according to the invention the paint quantity located in the paint lines is not lost, but instead is delivered back to and stored in the respective paint supply container, so that this paint can be reused during the next painting process that is to use the respective paint color. This achieves a considerable cost reduction. Moreover, in the design and arrangement of the overall equipment, the length of the paint lines is no longer relevant in relation to the costs of wasted paint. In other words, since the paint in the supply lines is not wasted, there is no longer an urge to make the paint lines as short as possible to reduce the amount of waste.

According to further details of the invention, the quantity of paint present in the paint line is positively pushed through the open color valve in the paint color switching device back into the paint supply line for that respective paint color, by using an auxiliary medium such as a flushing medium or a pressure medium that is introduced into the paint line at or near the spray nozzle end thereof. The pressure of this auxiliary medium must be greater than the pre-pressure of the paint being supplied by the paint supply line to the paint color switching device. Additionally, a shuttle element may be introduced into the paint line in the region between the paint spraying or atomizing nozzle and the paint color switching device, so as to be movably positioned between the advancing auxiliary medium and the paint that is being pushed back toward the paint supply container. In other words, the shuttle element is pushed along by and ahead of the auxiliary medium, while it remains movably located between the paint and the auxiliary medium.

The above objects have also been achieved according to the invention, in a painting apparatus comprising at least two paint supply containers for different types or colors of paint, a paint color switching device connected to the paint supply containers, a paint line connecting the paint color switching device to at least one paint applicator device such as an atomizing spray nozzle, and a movable shuttle element which is movably arranged in the paint line. A connector element is connected to the paint line between the paint color switching device and the spray nozzle, and serves for supplying an auxiliary medium, which may be a flushing medium such as water or a solvent, or which may be a pressure medium such as pressurized air, into the paint line. A respective receiver station for the shuttle element is arranged at the paint spray nozzle and at the paint color switching device. In this manner, the shuttle element may be introduced into the paint line to be movable through the paint line between the two receiver stations.

The shuttle element may be in the form of a so-called slug "go-devil" or "pipe cleaner swab" that forms a relatively tight seal between the paint on one side and the auxiliary medium on the other side, and that scrapes or swabs along the walls of the paint line as it moves along therein so as to clean the paint line. Alternatively, the shuttle element may simply be a separating element that does not form a tight seal in the paint line, but only forms an unsealed boundary between the paint and the auxiliary medium. The shuttle element may serve as an indicator or signaling element, either alone or together with the above described functions, so as to signal to a sensor that the transition or boundary between the paint and the auxiliary medium has reached a certain sensing location.

It should be understood that the term "paint" is used herein generally to refer to any paint, lacquer, varnish, stain, or other coating or treatment medium that is applied in a fluid state onto a workpiece. Similarly, the term "line" is used herein generally to refer to any hose, pipe, conduit, duct, channel or the like for conveying a fluid therein, and that these terms are used interchangeably. The concept of switching from one paint color or paint type to another, generally applies to switching between any two different fluids having different compositions or properties, whereby type-purity of the respective fluids is to be maintained, and wastage of one of the fluids while switching from one to the other is to be minimized.

BRIEF DESCRIPTION OF THE DRAWINGS

In order that the invention may be clearly understood, it will now be described in connection with an example embodiment, with reference to the accompanying drawings, wherein.

DETAILED DESCRIPTION OF PREFERRED EXAMPLE EMBODIMENTS AND OF THE BEST MODE OF THE INVENTION

Figure 1:
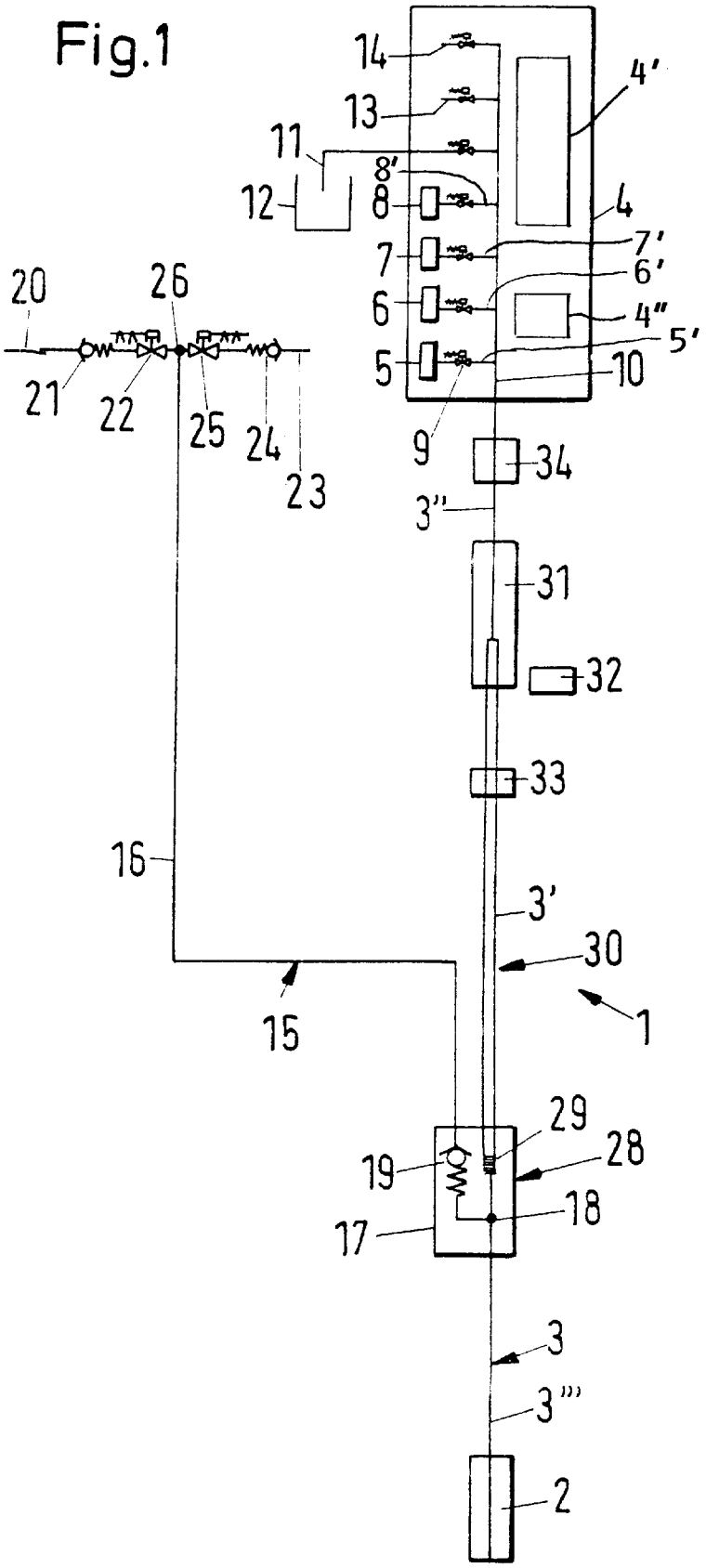
FIG. 1 is a schematic block circuit diagram of a paint spraying apparatus according to the invention, during a process step of spraying a first paint color up to the point of stopping the painting application.

The painting equipment or painting apparatus 1 as shown in the schematic block circuit diagram of FIG. 1 includes, at its work-piece facing end, a paint applying device such as a spray nozzle and particularly an atomizing nozzle 2, which is connected by a paint line 3 to a paint color switching device 4. The paint spraying nozzle 2 can comprise any desired or conventional paint applying device, and particularly may be a manually operable paint spraying gun. It should be understood that the paint color switching device 4 is not necessarily for switching colors, but can be used for switching among any different types of paints or other coatings. The paint switching device 4 includes or is connected to any desired number of paint supply containers 5, 6, 7 and 8 with their respective paint supply lines 5', 6', 7' and 8', for supplying paints of different types or colors. The paint in each supply container 5, 6, 7 and 8 is pressurized at a prescribed pre-pressure by means of any known pressurizing device, which is not shown, and may be pumped to the paint line 3 for spraying by a pump 4". The paint supply containers 5 to 8 are respectively connected to a common paint supply line 10 by the respective individual supply lines 5', 6', 7' and 8', whereby respective controllable valves 9 are interposed in the supply lines 5', 6', 7' and 8' between the supply containers 5 to 8 and the common supply line 10. The common supply line 10 in turn is connected to the paint line 3.

A drain line 11 is also connected to the common paint supply line 10 with another controllable valve 9 interposed therein, whereby the open or free end of the drain line 11 drains into a drain container 12. A similar arrangement pertains to a flushing medium supply 13 and also a pressurized air supply line 14, which are both connected to the common supply line 10 through controllable valves 9. The pressurized air provided to the supply line 14 may be a constant pressurized air supply, or may be a pulsating pressurized air supply. In order to ensure that the air supply as well as the supply of flushing medium and the draining line are effective for the entire system, the drain line 11, as well as the flushing medium supply 13 and the pressurized air supply 14 are connected to the common paint supply line 10 at an end opposite the paint spray nozzle 2 relative to the branching connection points for connecting the paint supply containers 5 to 8. In other words, the drain line 11, the flushing medium supply 13, and the air supply line 14 are connected to a far end of the system opposite the paint spray nozzle 2 with the paint supply containers 5 to 8 therebetween.

The equipment or painting apparatus 1 further includes special features for ensuring that at least a substantial portion or the majority of the paint located in the paint line 3 can be pushed back into the respective proper one of the paint supply containers 5, 6, 7 or 8 when the paint line 3, as well as the paint spraying nozzle 2 and the common paint supply line 10, must be cleaned to carry out a switch of the paint color or type. This is achieved by pushing the paint back into the proper supply container under the influence of pressure applied by an auxiliary medium that pushes the paint located in the paint supply line 3 from the side of the paint spraying nozzle 2 back in a return flow direction toward the paint color switching device 4. Then, by appropriately switching the controllable valves 9 by means of a controller 4', the paint is further pushed back into the proper supply container, such as the supply container 5, for example.

The auxiliary medium 15 used for pushing back the paint advantageously comprises a flushing fluid or a pressurizing medium 36 that is introduced into the paint line 3 at a location close to the spraying nozzle 2, from an auxiliary medium line 16 through a connector arrangement 17. The connector arrangement 17 comprises a line connector 18 connected to the paint line 3 and a non-return valve 19 by means of which the line connector 18 is connected to the auxiliary medium line 16 which supplies the auxiliary medium. Particularly, the auxiliary medium may advantageously comprise a flushing medium or simply pressurized air, which may be constantly supplied air or pulsating pressurized air. It is also possible that first pressurized air is supplied to push the paint back into the respective proper paint container, and thereafter a flushing medium is supplied to flush out any residual paint and completely clean the paint lines and associated components. The pressurized air and flushing medium may also be provided simultaneously together.

The auxiliary medium in the form of a flushing medium is supplied into the auxiliary medium line 16 from a supply container (not shown in FIG. 1) through a respective line 20 having a non-return valve 21 and a control valve 22 interposed therein, and being connected to the auxiliary medium line 16 by a T-connector 26. On the other hand, the auxiliary medium in the form of pressurized air is provided from a pressurized air source (which is also not shown in FIG. 1) into a respective line 23 that has a non-return valve 24 and a control valve 25 interposed therein, and that is ultimately connected through the T-connector 26 to the auxiliary medium line 16.

Furthermore, for pushing the paint back out of the line 3 and cleaning the paint line 3, the apparatus further comprises a shuttle element 29 particularly in the form of a so-called "slug", "go-devil" or "pipe cleaner swab" 29 in this embodiment, which is located in the paint line 3 so as to be movable therealong. More particularly, the element 29 serves the functions of a separating element providing a substantially sealed interface between the paint 35 and the auxiliary medium 15, and a cleaning element for mechanically cleaning the inner walls of the paint line 3, and/or a signalling device for signalling when the paint has been pushed back out of the paint line 3. This shuttle element and particularly the pipe swab cleaner 29 may simply be a spherical ball or a cylindrical body or barrel-shaped body made of a synthetic plastic material preferably having a smooth or low-friction surface. However, preferably, the pipe cleaner swab 29 has a special configuration as will be described below with reference to FIG. 6. The outer cross-sectional dimension of the pipe cleaner swab 29 may be substantially equal to or smaller than or even slightly larger than the cross-section of the paint line 3 within which it is received, as will be explained below.

The apparatus further includes two receiver stations 28 and 31 interposed in the paint line 3, with a portion 3' of the paint line 3 extending therebetween. More particularly, a first receiver station 28 is incorporated into the connector arrangement 17 that connects the auxiliary medium line 16 to the paint line 3 close to or at the spray nozzle 2. A second receiver station 31 is arranged close to or directly at the paint color switching device 4. A second portion 3" of the paint line 3 connects the second receiver station 31 to the paint color switching device 4, while a third portion 3'" of the paint line 3 connects the connector arrangement 17 to the paint spray nozzle 2. As such, the shuttle element 29 is able to shuttle back and forth between the two receiver stations 28 and 31, while passing through the flow path 30 of the paint line 3, and particularly the portion 3' of the paint line 3 between the two receiver stations 28 and 31. As will be described in greater detail below with reference to FIG. 6, the cross-sectional area of an inner bore within each receiver station is larger than the cross-sectional area of the shuttle element 29, so that the shuttle element 29 can "park" stationarily in either receiver station while the paint or the flushing medium (during a painting cycle or during a flushing cycle) flows around and past the shuttle element 29 through the respective receiver station 28 or 31.

The paint line portion 3' extending between the two receiver stations 28 and 31 may preferably be a flexible conduit or particularly a flexible hose. In this case, the shuttle element 29 preferably has a greater surface hardness and a lower elasticity than the flexible material of which the hose is made. In this case also, the outer cross-sectional dimension of the shuttle element 29 may be slightly greater than the nominal sectional dimension of the flexible hose forming the line portion 3', whereby the shuttle element 29 elastically expands the hose locally as it passes therethrough. In any case, depending on the elasticity of the line portion 3', the material of the shuttle element 29 is either more or less elastic as necessary to achieve an effective seal between the shuttle element 29 and inner wall of the paint line portion 3'.

A shuttle element removal arrangement 32 as well as a shuttle element sensor 33 are arranged in connection with the second receiver station 31. The shuttle element removal arrangement 32 allows the shuttle element 29 to be removed or exchanged, while the sensor 33 releases a control signal whenever the shuttle element 29 passes by the sensor 33 through the paint line portion 3'. The control signal released by the sensor 33 is provided to the system controller 4', which then properly switches over the controllable valves 9 of the paint color switching device 4, and the like, responsively to this sensor signal. The shuttle element 29 is so embodied in its configuration and the material from which it is made so that it can be electrically sensed or identified by means of a magnetic, inductive, optical or other sensor used as the sensor 33. The details of such different types of sensors are well known by persons of ordinary skill in the art.

Furthermore, a paint dosing device 34 is interposed in the paint line 3, and specifically in either the paint line portion 3' or the paint line portion 3". The dosing device 34 can be arranged at the beginning or the end of the paint line and serves for properly dosing or metering the quantity of paint that is to be supplied to the spray nozzle and applied during the painting process. Moreover, the dosing device 34 is so embodied that it allows the remaining portion of paint as well as flushing medium to flow therethrough in the reverse direction during a cleaning and flushing cycle.

The functions and manner of operation of the paint spraying apparatus 1 and its special components for cleaning the system will now be described. In normal operation during a paint spraying phase or cycle, the paint of a first color, for example supplied from the first paint supply container 5, flows through the common paint supply line 10 and from the paint color switching device 4 through the successive paint line portions, 3', 3", and 3'" and through each of the components interposed in the paint line 3 in a forward flow direction, to the paint spraying nozzle 2, from which it is sprayed onto the workpiece. During this paint spraying operation, the shuttle element 29 is located in the downstream or nozzle-facing receiver station 28, as shown in FIG. 1. The paint flows around and past the shuttle element 29 in this receiver station 28. The same arrangement also pertains during a painting stop, i.e. when the paint flow is stopped at the end of a painting process using the first paint color.

Figure 2:
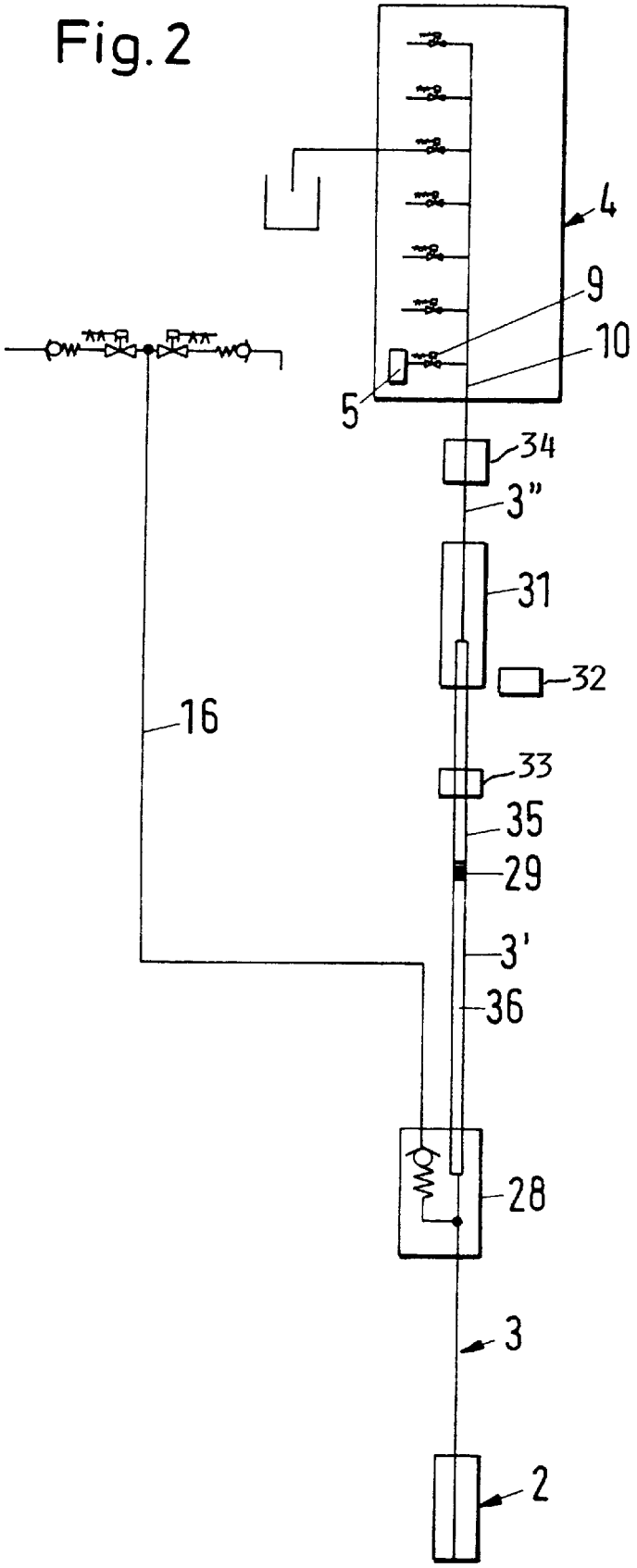
FIG. 2 is a schematic block circuit diagram showing the painting apparatus of FIG. 1 in a subsequent process step of pushing the paint out of the paint line back toward the paint supply.

When it is necessary to switch to a different paint color, a back-flow, cleaning and flushing cycle must first be carried out. In order to clean the portions 3' and 3" of the paint line 3, as well as essential portions of the common paint supply line 10 in the paint color switching device 4, the pressure medium such as compressed air, or optionally the flushing medium is provided under pressure from the auxiliary medium line 16 through the connector arrangement 17 including the first receiver station 28 into the paint line portion 3'. This pressure medium or flushing medium pushes the shuttle element 29 out of its parked position in the first receiver station 28 and pushes it along the line portion 3'in the return direction. Thereby, the shuttle element 29 is located between and separates the pressure medium or flushing medium (i.e. the auxiliary medium 15) and the paint 35, while the auxiliary medium 15 pushes or drives the shuttle element 29 through the line portion 3' and pushes the paint 35 through the line portions 3' and 3", and ultimately also through the common paint supply 10 back into the supply container 5 from which the paint 35 came. To achieve this, the respective controllable valve 9 connected to the paint supply container 5 is opened, while the other controllable valves 9 are closed. The flow is achieved simply by applying a greater pressure of the pressure medium or flushing medium in the auxiliary medium line 16 than the pre-pressure of the paint that exists in the common paint supply line 10. This stage of the process is represented in FIG. 2.

Figure 3:
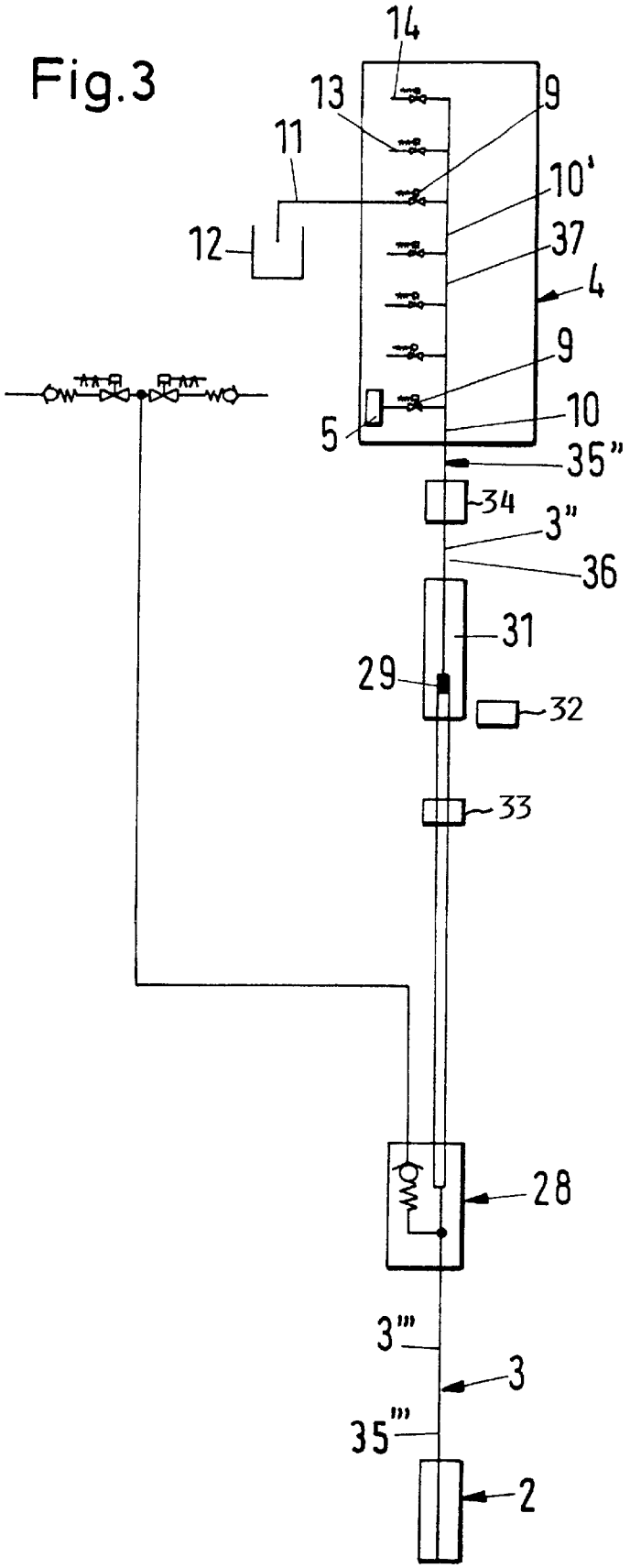
FIG. 3 is a schematic block circuit diagram of the painting apparatus in a subsequent stage of pushing back the paint from the paint line back to the supply.

The shuttle element 29 continues to move through the portion 3' of the paint line 3 until it reaches and enters the second receiver station 31. The sensor 33 signals the arrival of the shuttle element 29 to the system controller, and the shuttle element 29 assumes a parking position in the second receiver station 31, as shown in FIG. 3. While the shuttle element 29 is in this parking position, the pressure medium 36 can flow past the shuttle element 29 so as to push the paint 35" remaining in the pipe line portion 3" and in the common paint supply line 10 up to the control valve 9 just before the paint supply container 5 in the paint color switching device 4, at least partially back into the supply container 5. The system controller 4' uses the signal provided by the sensor 33 to determine when to close the valve 9 leading to the first supply container 5 (e.g. by a time delay after receiving the signal), especially in the event that a flushing medium is used as the auxiliary medium 15, to prevent the flushing medium from flowing through the valve 9 and into the paint supply container 5, i.e. to maintain the purity of the paint supply in the container 5.

At the same time as closing the valve 9 leading to the supply container 5, the control valve 9 leading to the drain line 11 and from there to the drain container 12 is opened, so that an absolute rest 37 of the paint is pushed by the auxiliary medium 15 through the portion 10' of the common paint supply line 10 and out through the drain line 11 into the drain container 12. At this stage, most of the paint from the paint line has been pushed back into the supply container from which it came, and substantially only air or flushing medium is in the painting apparatus 1 in the system between the first receiver station 28 and the drain line 11 of the paint color switching device 4. If pressurized air was simply used initially as the pressure medium 36 forming the auxiliary medium 15, it may now be desired to flush out the paint line using the flushing medium supplied from the flushing medium line 20 into the auxiliary medium line 16. This flushing medium can flush the paint line 3 back through the drain line 11, and can also be allowed to flush out through the paint line portion 3'" and the spray nozzle 2.

Figure 4:
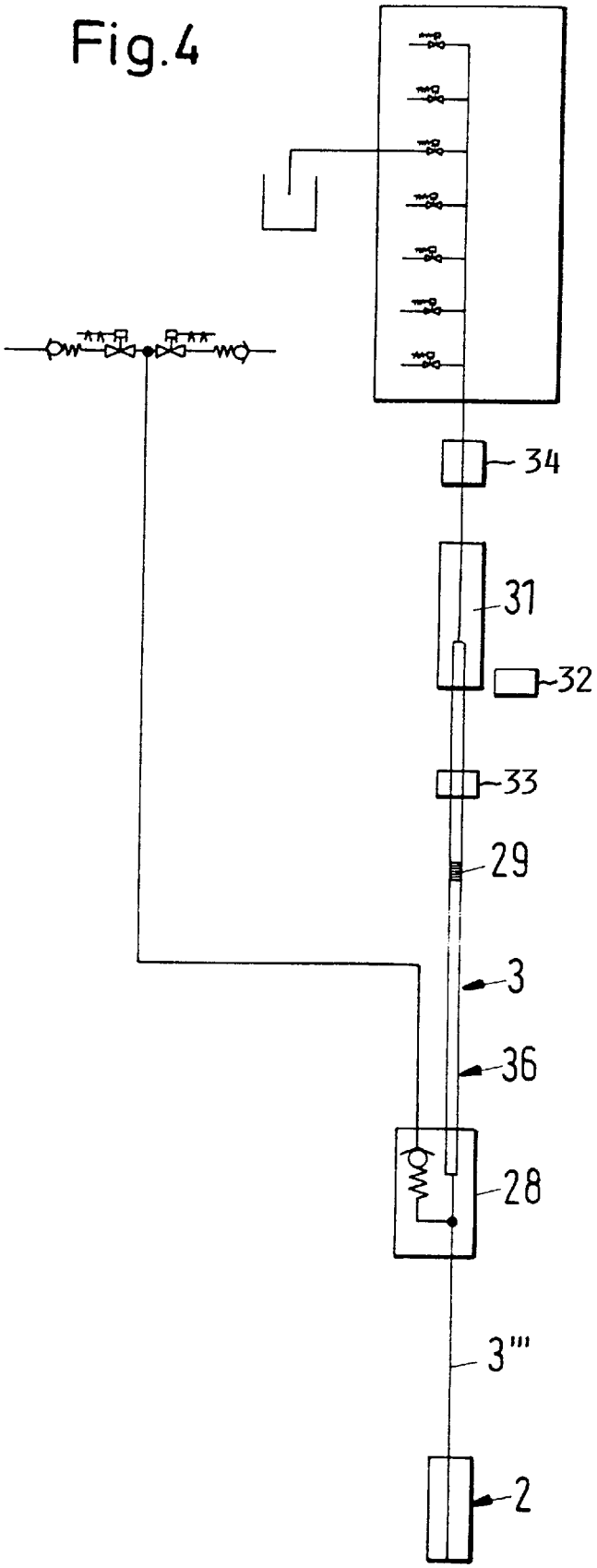
FIG. 4 is a schematic block circuit diagram showing the painting apparatus in a further cleaning step.
Figure 5:
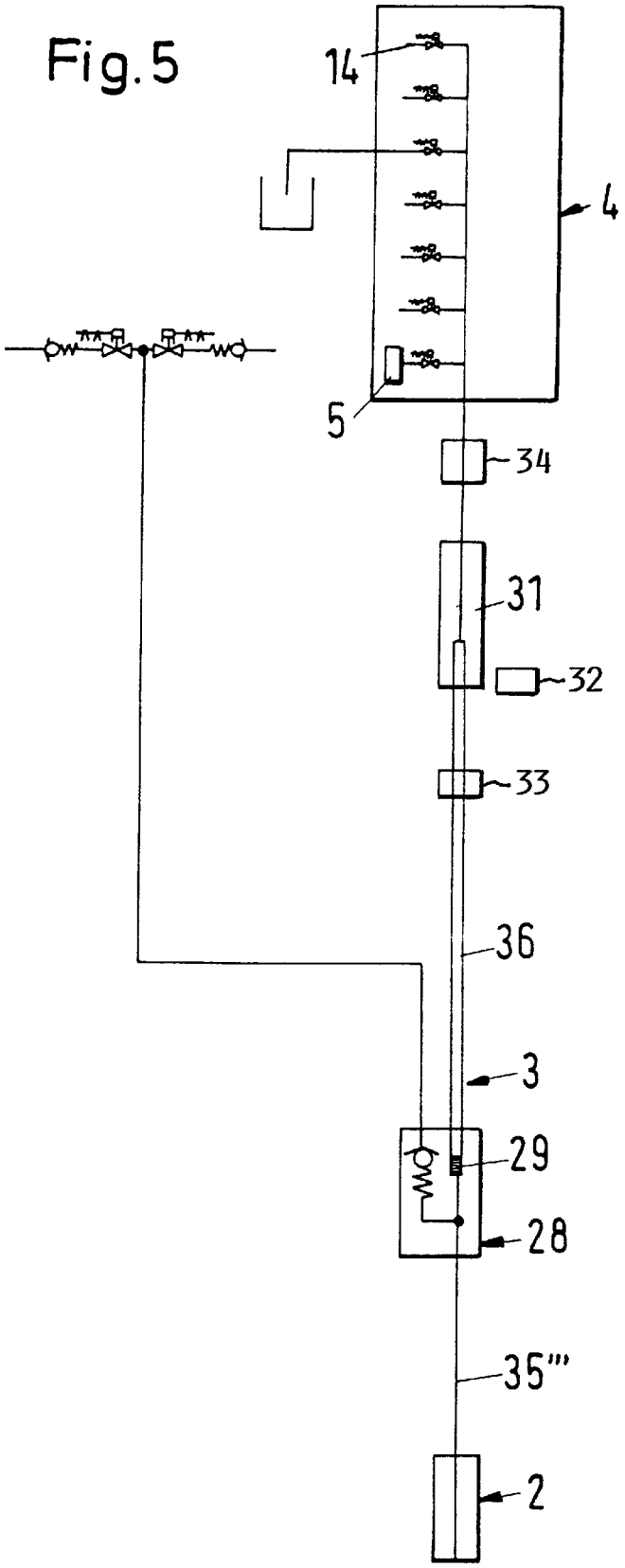
FIG. 5 is a schematic block circuit diagram showing the painting apparatus in a stage at the end of the cleaning process.

As a further or alternative measure to clean out the paint line portion 3'" between the receiver station 28 and the spraying nozzle 2, as well as to provide a final flushing of the entire paint line including and from the paint color switching device 4 through the entire paint line 3 and out through the nozzle 2, a flushing medium is provided from the flushing medium supply 13, while pressurized air is introduced into the pressurized air supply line 14 in the paint color switching device 4. The pressurized air supplied to the line 14 forcefully flushes the flushing medium from the supply 13 through the entire paint line 3, and particularly through the paint line portion 3'" and the spraying nozzle 2, so as to flush any remaining paint 35'" out through the spraying nozzle 2. During this step, the shuttle element 29 is pushed out of its parking position in the second receiver station 31 and is pushed through the paint line 3, as shown in FIG. 4, back into its parking position in the first receiver station 28, wherein the flushing medium will flow around and past the shuttle element 29 as shown in FIG. 5.

At the end of the cleaning or flushing process, the supply of flushing medium through the line 13 is discontinued, while the pressurized air supply through the line 14 is continued so as to blow the remaining flushing medium out of the paint line 3 and all the components interposed therealong, whereby any remaining paint rests 35'" are flushed out through the spray nozzle 2 together with the residual flushing medium and pressurized air. This situation as well is shown in FIG. 5.

While carrying out this cleaning and flushing cycle, it is to be understood that all valves, pumps and other components of the system are operated under the control of a system controller in a properly sequenced manner so that the cleaning of the paint line 3 and preparing of the system for carrying out a switch of the type or color or paint can be achieved with the smallest possible loss of the paint remaining in the paint line 3 at the end of a painting cycle. This is achieved especially in connection with the signal provided by the sensor 33. By controlling the proper valves 9 with an appropriate time delay after the sensor 33 releases its signal, it is possible to precisely tune the recovery of paint into the respective paint supply containers, without contaminating that paint with the flushing medium or the like. Avoidance of contamination can also be ensured by using pressurized air as the first pressurized medium, and only following thereafter with the flow of flushing medium. Even if the length of the paint line portion 3' is varied to suit different painting application requirements, the controller does not need to be reprogrammed, since the distance between the sensor 33 and the respective paint supply containers in the paint color switching device 4 remains the same.

Figure 6:
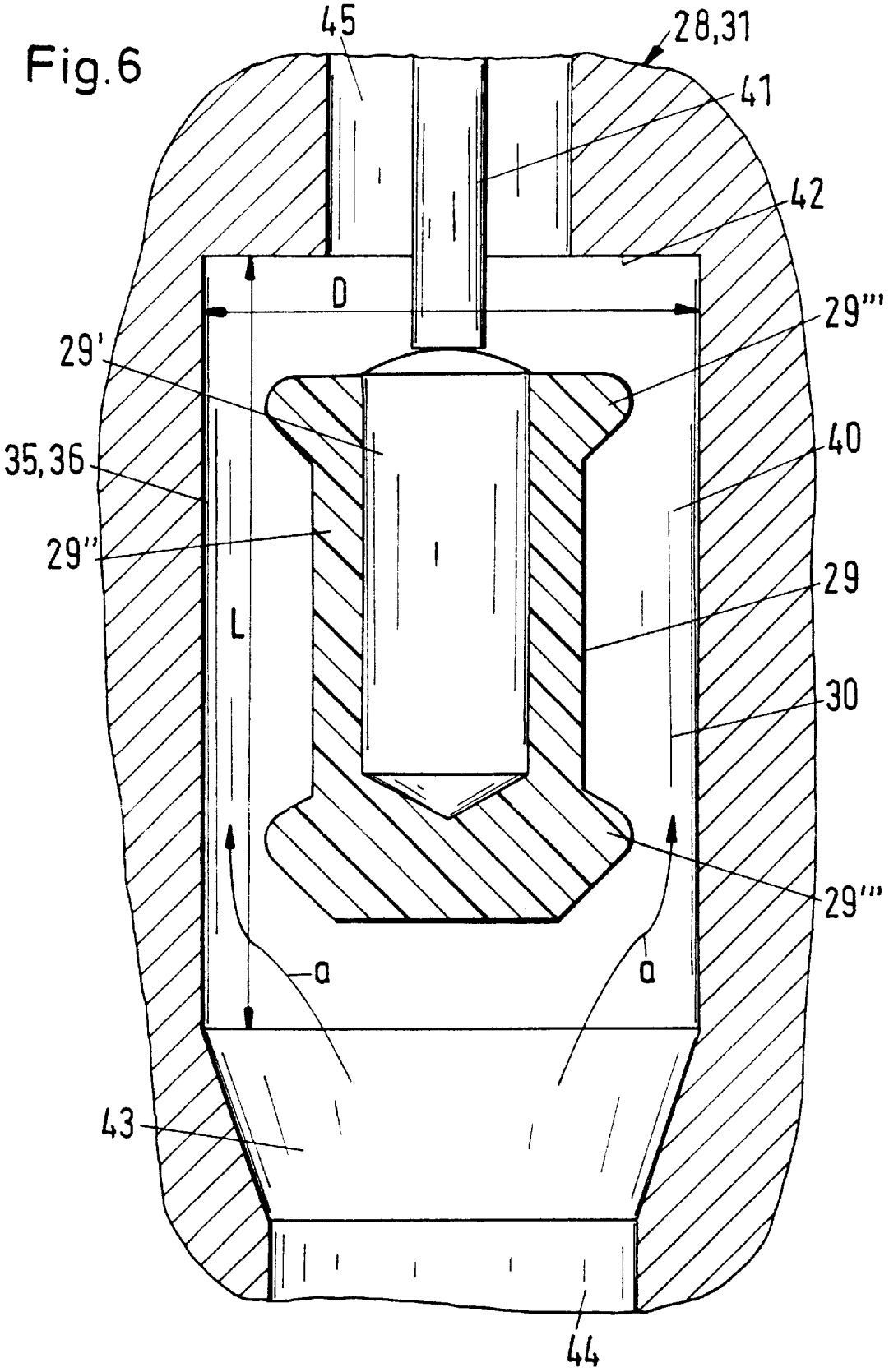
FIG. 6 is an enlarged detailed sectional view of a pipe cleaner swab element received in a respective receiver station.

A preferred structure of the receiver stations 28 and 31 in combination with the shuttle element 29 will now be described with reference to FIG. 6. Each one of the receiver stations 28 and 31, which respectively act as a parking station for the shuttle element 29, respectively enclose a chamber 40 therein, having a diameter D and a length L that are respectively greater than the corresponding diameter and length of the shuttle element 29. The receiver stations 28 and 31 further respectively comprise a pin- or peg-shaped stop 41 that protrudes into the interior of the chamber 40, such that the shuttle element 29 will stop against the stop 41 and thereby be prevented from resting against the end face 42 of the chamber 40. In this manner, it is ensured that a free clearance passage or flow path 30 exists all around the shuttle element 29 within the chamber 40, such that paint 35 or the flushing medium or the pressure medium 36 can flow around the shuttle element 29 through the chamber 40 in the direction of flow arrows a.

At the end of the chamber 40 opposite the stop 41 and the chamber end face 42, the chamber 40 preferably comprises a conical transition zone 43 connected to an outlet or inlet opening 44, which is dimensioned such that the shuttle element 29 can pass through the opening 44 into and out of the chamber 40 depending on the respective flow direction of the paint 35 or flushing medium 36. For both the first receiver station 28 and the second receiver station 31, the opening 44 is connected to the portion 3' of the paint line 3 extending between the two receiver stations 28 and 31. The diameter of the opening 44 is smaller than the diameter D of the chamber 40, but instead substantially corresponds to the inner diameter of the paint line portion 3'. This paint line portion 3' may be connected to the opening 44 in any known manner.

At the end of the chamber provided with the end face 42 and the stop 41, the chamber 40 has a second inlet or outlet opening 45. In the case of the first receiver station 28, the opening 45 is connected to the portion 3'" of the paint line 3 leading to the paint spraying nozzle 2. In the case of the second receiver station 31, the opening 45 is connected to the portion 3'" of the paint line 3 leading to the paint color switching device 4. Preferably, the diameter of the opening 45 is smaller than that of the opening 44, but this is not necessary. In the illustrated embodiment, the pin-shaped stop 41 extends axially out of the opening 45, but this is not necessary. Instead, stop protrusions or a stop cage could be arranged to protrude into the chamber 40 from the end face 42 thereof.

A preferred construction of the shuttle element 29 in the form of a pipe cleaner swab or "go-devil" is shown in FIG.

6. This shuttle element 29 is a generally cylindrical body having at least one end with a conical frustum shape. The shuttle element 29 preferably comprises a steel core 29' and a synthetic plastic casing or outer jacket 29". The steel core 29' serves to be detectable or to provide a signal when it passes by the above described sensor 33. The sensor 33 can also be connected or incorporated in the stop 41, so that the arrival and contact of the shuttle element 29 on the stop 41 provides the necessary signal.

The synthetic plastic jacket or casing 29" is advantageously made of an acetal resin, and specifically a polyoxymethylene (POM) thermoplastic homopolymer, which is commercially available under the trademark "Delrin" for example. This polymer is quite hard and strong, yet remains tough and resilient, i.e. is not brittle, and is generally resistant to attack by paints, solvents, and other chemicals. This material also provides a low friction surface for the shuttle element 29 passing through the paint line 3. Alternatively, the shuttle element may comprise other plastics, rubber, metal, foam, ceramic or combinations thereof.

To provide the desired pipe scraping or pipe scrubbing effect, the outer casing 29" of the shuttle element 29 preferably but not necessarily comprises two outwardly protruding ring-shaped beads, lips or rims 29'" at each respective end of the generally cylindrical shaped body of the shuttle element 29. These beads or rims 29'" scrub along the inner wall of the paint line 3 and form an effective low-friction seal, so that the paint can be removed from the paint line 3 with high effectiveness and so as to tightly seal the boundary between the paint and the auxiliary medium while the shuttle element is traveling through the paint line portion 3'. The dimensions of the shuttle element 29, and especially the outer diameter of the beads or rims 29'" are matched to the inner diameter and tolerances of the paint line 3, and particularly the portion 3' thereof. The length of the overall shuttle element 29 can be in the range from a few millimeters to a few centimeters.

The method and apparatus of the invention are not limited to the example embodiment that has been concretely described above with reference to the drawings. Rather, variations and modifications are also possible within the scope of the basic invention. Especially, the method of the invention can be carried out without using a mechanical shuttle element 29 as described above, as a separating element between the paint 35 and the auxiliary medium 15. Instead, the method can be carried out without a physical or mechanical boundary between the paint 35 and the auxiliary medium 15, whereby the pressurized air or flushing medium simply pushes the paint back through the paint line 3. In this case, the boundary between the paint 35 and the auxiliary medium 15 is ascertained by volume measurement of the returning paint flow, or by sensors such as optical sensors or the like that can distinguish when the paint/pressure medium boundary passes by the respective sensor. In this manner, it is still possible to ensure that the respective control valve 9 returning to the paint supply container is closed and the drain line 11 is opened at the appropriate time to ensure that only clean uncontaminated paint is returned to the paint supply container. In such a case of omitting the shuttle element 29, it is also possible to omit the receiver stations 28 and 31.

The above described embodiment includes a permanent connection of the auxiliary medium line 16, i.e. the line for providing the pressure medium or flushing medium, to a location close to the spray nozzle 2. Alternatively to such a permanent connection, the auxiliary medium line 16 may be manually temporarily connectable. In this manner, the auxiliary medium line 16 may be left unconnected during the spraying operation, and then is connected only when a color switch and respective paint line flushing operation are to be carried out. This is particularly advantageous when the spray nozzle 2 is a hand-held paint spray gun, because this improves the mobility of the paint spray gun during the spraying operation. Particularly, the auxiliary medium line 16 may then be connected to a spray gun flushing station, rather than directly to the spray gun itself.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A paint application system comprising:

a paint supply switching device including at least one paint supply line;

a paint applicator;

a paint line connecting said paint supply switching device to said paint applicator;

first and second receiver stations interposed in said paint line between said paint supply switching device and said paint applicator, with said first receiver station adjacent said paint applicator and said second receiver station adjacent said paint supply switching device;

a shuttle element that is arranged in and movable back and forth through said paint line between said first and second receiver stations, wherein said shuttle element and said first receiver station are so configured that paint can flow past said shuttle element through said first receiver station when said shuttle element is located in said first receiver station during a paint application stage; and a connector arrangement connected to said paint line at a location selected from said first receiver station, said paint applicator, and between said first receiver station and said paint applicator, wherein said connector arrangement is adapted to supply an auxiliary medium into said paint line at said location so as to push said shuttle element from said first receiver station through said paint line into said second receiver station during a paint recovery stage.

2. The paint application system according to claim 1, wherein said paint supply switching device further comprises a respective controllable valve arranged in each said at least one paint supply line, and a controller unit connected to each said respective controllable valve.

3. The paint application system according to claim 2, wherein said at least one paint supply line includes at least first and second paint supply lines, and further comprising at least first and second paint supply containers that are respectively connected with said first and second paint supply lines and that are respectively adapted for containing first and second different paints therein.

4. The paint application system according to claim 2, wherein said paint supply switching device further comprises a flushing medium supply line adapted to be connected to a source of a flushing medium, a pressurized air supply line adapted to be connected to a source of pressurized air, a drain line, and a common supply line connected in flow sequence order to said pressurized air supply line, said flushing medium supply line, said drain line, said at least one paint supply line, and then to said paint line.

5. The paint application system according to claim 1, wherein said paint applicator comprises a spraying nozzle.

6. The paint application system according to claim 1, wherein at least one of said receiver stations comprises a removal station associated therewith and adapted to allow said shuttle element to be removed through said removal station.

7. The paint application system according to claim 1, further comprising a sensor arranged in or at said second receiver station and adapted to sense the presence of said shuttle element.

8. The paint application system according to claim 1, further comprising a paint dosing device connected to said paint supply switching device.

9. The paint application system according to claim 1, wherein each one of said receiver stations respectively comprises a housing wall with a chamber therein, and a passage opening and a fluid flow opening extending through said housing wall and into said chamber at opposite ends thereof, wherein said chamber has a lateral dimension greater than a diameter of said shuttle element so that said shuttle element can be received in said chamber with a flow space between said shuttle element and said housing wall allowing fluid flow from said passage opening past said shuttle element to said fluid flow opening, wherein said passage opening of each said receiver station has a diameter equal to or greater than said diameter of said shuttle element and is respectively connected to a portion of said paint line extending between said first and second receiver stations, and wherein said fluid flow opening of said first receiver station is connected to a portion of said paint line extending between said first receiver station and said paint applicator, and said fluid flow opening of said second receiver station is connected to a portion of said paint line extending between said second receiver station and said paint supply switching device.

10. The paint application system according to claim 9, wherein each said receiver station further comprises a stop member connected to said housing wall and protruding into said chamber adjacent said fluid flow opening so as to stop travel of said shuttle element toward said fluid flow opening at a spacing away from said fluid flow opening.

11. The paint application system according to claim 10, wherein said stop member comprises a pin extending coaxially in said fluid flow opening and protruding coaxially into said chamber.

12. The paint application system according to claim 1, wherein said shuttle element comprises a cleaner swab having a maximum outer diameter substantially matching an inner diameter of a portion of said paint line extending between said first and second receiver stations.

13. The paint application system according to claim 12, wherein said cleaner swab has a substantially cylindrical body with two circular rims protruding radially outwardly from said body around a circumference thereof respectively at two opposite ends thereof, and wherein said maximum outer diameter is an outer diameter of said circular rims.

14. The paint application system according to claim 13, wherein said cleaner swab comprises a metal core and a plastic outer casing around said metal core, wherein at least said circular rims are formed in said plastic outer casing.

15. The paint application system according to claim 12, wherein said cleaner swab comprises a metal core and a plastic outer casing around said metal core.

16. The paint application system according to claim 12, wherein said cleaner swab at least partly consists of a polyoxymethylene plastic material.

17. The paint application system according to claim 1, wherein said connector arrangement is incorporated into said first receiver station.

18. The paint application system according to claim 1, further comprising an auxiliary medium line connected to said connector arrangement and adapted to supply said auxiliary medium.

19. The paint application system according to claim 18, wherein said auxiliary medium line is further connected to a source of pressurized air and to a source of flushing liquid, and wherein said auxiliary medium selectively comprises at least one of said pressurized air and said flushing liquid.

20. A method of using a paint application system including a paint switching device connected to a first paint container containing a first paint and to a second paint container containing a second paint different from said first paint, a paint applicator, a paint line connecting said paint switching device and said paint applicator, and a shuttle element arranged to be movable back and forth in said paint line, said method comprising the following steps:

a) flowing said first paint from said first paint container through said paint line to said paint applicator in a forward flow direction, and then ceasing said flowing of said first paint;

b) moving said shuttle element through said paint line in a return direction from said paint applicator toward said paint switching device and thereby pushing at least a predominant portion of said first paint remaining in said paint line after said step a) back into said first paint container; and c) flowing said second paint from said second paint container through said paint line to said paint applicator in said forward flow direction.

21. The method according to claim 20, wherein said step b) comprises forcefully causing said moving of said shuttle element and said pushing of at least a predominant portion of said first paint back into said first paint container by introducing an auxiliary medium selected from a flushing liquid and pressurized air into said paint line and pushing said shuttle element using said auxiliary medium.

22. The method according to claim 20, further comprising using said shuttle element to trigger the release of a signal indicating the arrival of said shuttle element at a particular location.

23. The method according to claim 21, further comprising, between said steps b) and c), a first additional step of causing a residual amount of said first paint still present in said paint line after said step b) to flow in said return direction through a drain line and into a drain container, using said auxiliary medium, and then a second additional step of flushing out said paint line completely through to said paint applicator in said forward flow direction using a flushing medium and pulsed pressurized air, and then blowing out said paint line using only pressurized air.

24. The method according to claim 20, wherein said paint application system further includes a receiver station interposed in said paint line adjacent said paint applicator, wherein said step a) of flowing said first paint in said forward flow direction comprises supplying said first paint under pressure so as to flow said first paint around and past said shuttle element to said paint applicator with said shuttle element located and remaining in said receiver station, and wherein said step c) of flowing said second paint in said forward flow direction comprises supplying said second paint under pressure so as to flow said second paint around and past said shuttle element to said paint applicator with said shuttle element located and remaining in said receiver station.

25. The method according to claim 20, wherein said step a) further comprises continuing to supply said first paint from said first paint container an entire time while emitting said first paint from said paint applicator, and wherein said ceasing of said flowing of said first paint comprises stopping said emitting of said first paint from said paint applicator.

26. A paint application system comprising:

a paint supply switching device including at least one paint supply line;

a paint applicator;

a paint line connecting said paint supply switching device to said paint applicator;

first and second receiver stations interposed in said paint line, with said first receiver station adjacent said paint applicator and said second receiver station adjacent said paint supply switching device;

a shuttle element arranged to be received in and movable through said paint line between said first and second receiver stations; and a connector arrangement that is incorporated into said first receiver station, connected to said paint line at said first receiver station, and adapted to supply an auxiliary medium into said paint line at said first receiver station.

* * * * *